US006899009B2

(12) United States Patent
Christiansen et al.

(10) Patent No.: US 6,899,009 B2
(45) Date of Patent: May 31, 2005

(54) FLEXIBLE MULTI-SHOCK SHIELD

(75) Inventors: Eric L. Christiansen, Houston, TX (US); Jeanne L. Crews, Santa Fe, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/892,355

(22) Filed: Jun. 26, 2001

(65) Prior Publication Data

US 2002/0195030 A1 Dec. 26, 2002

(51) Int. Cl.[7] ..... F41H 5/02
(52) U.S. Cl. ..... 89/36.02
(58) Field of Search ..... 89/36.02, 36.07

(56) References Cited

U.S. PATENT DOCUMENTS

| | | | | | |
|---|---|---|---|---|---|
| 578,000 | A | * | 3/1897 | Zeglen | 112/420 |
| 2,744,846 | A | * | 5/1956 | Stickles | 156/291 |
| 3,649,426 | A | * | 3/1972 | Gates, Jr. | 109/84 |
| 3,930,452 | A | * | 1/1976 | Van Laethem et al. | 109/49.5 |
| 4,732,803 | A | * | 3/1988 | Smith, Jr. | 109/49.5 |
| 4,836,084 | A | | 6/1989 | Vogelesang et al. | 89/36.02 |
| 5,067,388 | A | | 11/1991 | Crews et al. | 89/36.02 |
| 5,102,723 | A | | 4/1992 | Pepin | 428/223 |
| 5,196,252 | A | * | 3/1993 | Harpell | 109/80 |
| 5,217,185 | A | | 6/1993 | Rucker | 244/121 |
| 5,317,950 | A | * | 6/1994 | Binon et al. | 2/2.5 |
| 5,377,935 | A | * | 1/1995 | Larriva et al. | 244/121 |
| 5,440,965 | A | * | 8/1995 | Cordova et al. | 428/911 |
| 5,463,929 | A | * | 11/1995 | Mejia | 109/49.5 |
| 5,601,258 | A | * | 2/1997 | McClymonds | 244/158 R |
| 5,610,363 | A | | 3/1997 | Crews et al. | 89/36.02 |
| 5,996,115 | A | * | 12/1999 | Mazelsky | 2/2.5 |
| 6,161,462 | A | * | 12/2000 | Michaelson | 102/303 |
| 6,253,655 | B1 | * | 7/2001 | Lyons et al. | 89/36.02 |
| 6,276,254 | B1 | * | 8/2001 | Cordova et al. | 2/2.5 |
| 6,298,765 | B1 | * | 10/2001 | Dvorak | 89/36.02 |
| 6,370,690 | B1 | * | 4/2002 | Neal | 2/2.5 |

FOREIGN PATENT DOCUMENTS

DE 3508848 A1 * 9/1986

* cited by examiner

*Primary Examiner*—Michael J. Carone
*Assistant Examiner*—Jordan Lofdahl
(74) *Attorney, Agent, or Firm*—Theodore U. Ro

(57) ABSTRACT

Flexible multi-shock shield system and method are disclosed for defending against hypervelocity particles. The flexible multi-shock shield system and method may include a number of flexible bumpers or shield layers spaced apart by one or more resilient support layers, all of which may be encapsulated in a protective cover. Fasteners associated with the protective cover allow the flexible multi-shock shield to be secured to the surface of a structure to be protected.

10 Claims, 5 Drawing Sheets

FLEXIBLE MULTI-SHOCK SHIELD

This application is the U.S. national phase of international application PCT/EP03/02310 filed 06 Mar. 2003, which designated the U.S.

ORIGIN OF THE INVENTION

The invention described herein was made by employee(s) of the United States Government and may be manufactured or used by or for the Government of the United States of America for governmental purposes without the payment of any royalties thereon or therefor.

BACKGROUND OF THE INVENTION

1. Field of the Invention

The invention relates generally to shielding schemes and, more particularly, to a flexible multi-shock shield system and method therefor.

2. Description of the Related Art

In planning for space operations which involve long duration space flights and permanently orbiting structures such as space stations and satellites, design engineers are faced with the problem of defending such structures from impact with particles of orbital debris. Protection schemes have been devised, for example, to protect the space stations and spacecrafts from orbital debris during long duration space operations. For example, a number of shield systems have been devised for protecting space stations and spacecrafts against micrometeoroids, which typically have densities of about 1 g/cm$^3$ and velocities of up to 20 km/s. Shield systems have also been devised for protecting against denser, somewhat slower moving particles of orbital debris generally referred to as "hypervelocity particles."

Prior art systems for protecting against hypervelocity particles have included both single sheet shields and dual sheet shields. An impact with the sheets of such shields, however, may actually generate additional debris that can potentially damage the surface being protected. For example, the hypervelocity particles typically fragment, melt and vaporize upon impact with the shield into a debris plume which consists of a large number of fine, solid debris particles from the impacting projectile and the shield. As this solid debris collides with subsequent sheets of the shield, more debris may be added to the debris plume, and if the shield is not properly designed, the result could be that each sheet does not assist the process of destroying the hypervelocity particle as much as it adds more material for impact with the next sheet. Consequently, a very thick back wall may be needed in the prior art shields to dissipate the energy of the resulting debris plume.

Moreover, such prior art shield systems often are rigid and have little or no flexibility, making them difficult to store, transport, and deploy. Such difficulties are compounded for operations in space where the cargo and storage capacities of space stations and spacecrafts are limited. In addition, such prior art shield systems may be somewhat bulky and difficult to deploy and attach, particularly on a curved or otherwise non-planar surface. As a result, the number and types of applications in which such prior art shield systems can be effectively employed may be relatively limited.

Accordingly, it is desirable to provide a flexible multi-shock shield system and method which not only can defend against hypervelocity particles, but is also easy to store and deploy.

SUMMARY OF THE INVENTION

The invention is directed to a flexible multi-shock shield system and method for defending against hypervelocity particles. The flexible multi-shock shield system and method may include a number of flexible shield layers spaced apart by one or more resilient support layers, all of which may be contained within or "encapsulated" in a protective cover. Fasteners attached to the protective cover allow the flexible multi-shock shield to be secured to the surface of a structure to be protected.

In general, in one aspect, the invention is directed to a particle shield. The particle shield comprises a plurality of flexible shield layers. A resilient support layer is disposed between adjacent ones of the flexible shield layers. A protective cover is configured to enclose the flexible shield layers. Fasteners are integrally formed with or attached to the protective cover or one of the other layers and are capable of releasably securing the flexible shield layers to a structure to be protected.

In general, in another aspect, the invention is directed to a protection system against hypervelocity particles. The protection system comprises means for shocking the impacting hypervelocity particles to substantially fragment or vaporize the hypervelocity particles. The protection system further comprises means for supporting the shocking means in a resilient manner, means for enclosing the shocking means in a cover layer; and means for securing the shocking means on a structure to be protected.

In general, in another aspect, the invention is directed to a method of protecting against hypervelocity particles using a flexible multi-shock shield. The method comprises reducing a size and volume occupied by the flexible multi-shock shield and transporting the flexible multi-shock shield to a desired location. The method further comprises expanding the flexible multi-shock shield to its initial size and volume, and securing the flexible multi-shock shield on a structure to be protected. The flexible multi-shock shield is thereafter used to shock the hypervelocity particles.

In general, in another aspect, the invention is directed to a hypervelocity particle shield. The shield comprises a plurality of spaced apart flexible shield layers, at least one of which is made of a flexible ceramic fabric, and a resilient support layer between adjacent ones of the flexible shield layers, the resilient support layer including at least one space qualified open-cell foam layer. Multiple layers of open-cell foam and shield layers are arrayed in a sandwich structure, one against the other, in one embodiment. At least one thermal insulation layer is disposed on the plurality of flexible shield layers. A vented, abrasion resistant protective cover is configured to enclose the flexible shield layers, the protective cover having an absorptivity to emissivity ratio selected to provide a predetermined level of thermal protection. Fasteners are attached to or integrally formed with the protective cover and are capable of releasably securing the flexible shield layers to a structure to be protected.

BRIEF DESCRIPTION OF THE DRAWINGS

A more complete understanding of the system and method of the present invention may be had by reference to the following detailed description when taken in conjunction with the accompanying drawings, wherein.

DETAILED DESCRIPTION OF THE DRAWINGS

Figure 1:
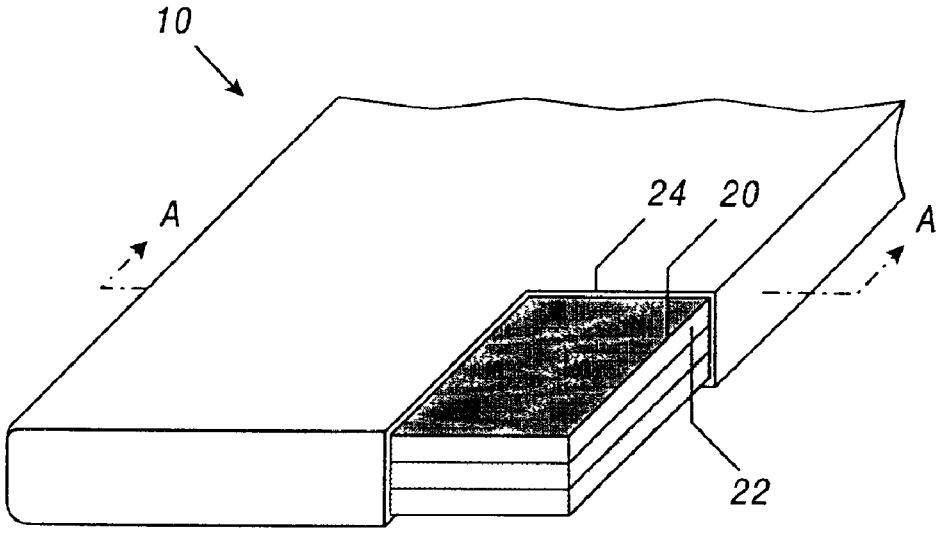
FIG. 1 illustrates a perspective view of a flexible multi-shock shield according to some embodiments of the invention.

Following is a detailed description of the drawings wherein reference numerals for like elements are carried forward.

Embodiments of the invention provide a versatile, lightweight and flexible multi-shock shield that is not only capable of defending against hypervelocity particles, but can also be easily stored, transported, and deployed. In some embodiments, the shield may include a plurality of flexible bumpers or shield layers. Adjacent ones of the flexible shield layers may be spaced apart and supported by a resilient support layer. Such an arrangement allows the flexible multi-shock shield to be compressed, folded, or otherwise reduced in volume for easy storage and transport. A protective cover may be employed to enclose or encapsulate the flexible shield layers and the resilient support layer. Fasteners may be attached to or integrally formed with the protective cover to allow the flexible shield layers to be secured to a surface of the structure to be protected. Such an arrangement allows the flexible multi-shock shield to be quickly and easily deployed and/or taken down as needed. Holes or perforations may be formed around the periphery of the protective cover on opposing side of the flexible multi-shock shield, and vent paths may be cut out of the resilient support layers. Such an arrangement facilitates venting and releasing of any pressure that may have built up in the flexible multi-shock shield.

Referring now to FIG. 1, a perspective view of the flexible multi-shock shield 10 according to some embodiments of the present invention is shown. The flexible multi-shock shield 10 may be configured as a pad or mattress, as shown here, which is suitable for protecting flat or, because of its flexibility, curved surfaces such as an exterior wall or a spacecraft bulkhead, or any other suitable configuration as needed by a particular application. The flexible multi-shock shield 10 includes a number of different layers which are described below.

Figure 2:
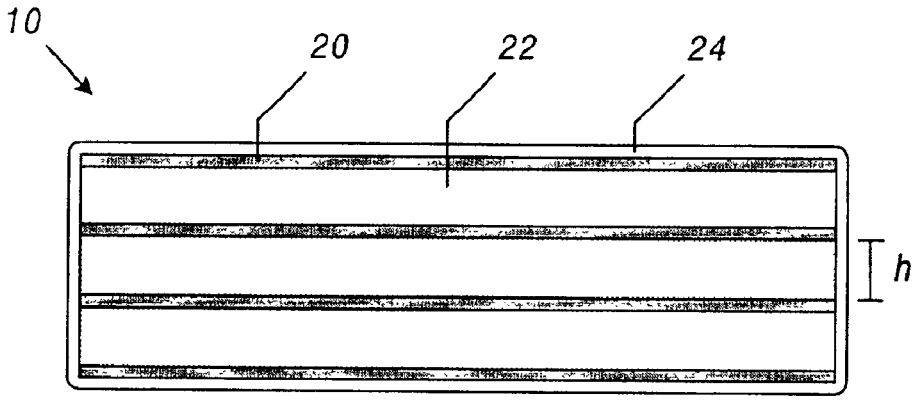
FIG. 2 illustrates a cross-sectional view of a flexible multi-shock shield according to some embodiments of the invention.

FIG. 2 illustrates a close-up cross-sectional view of the flexible multi-shock shield 10 taken at line A—A. As can be seen, the flexible multi-shock shield 10 may include a number of thin flexible bumpers or shield layers 20 spaced apart at substantially equal distance from each other. Although four flexible shield layers 20 are shown in FIG. 2, a fewer or greater number of flexible shield layers 20 may certainly be used as needed depending on the particular needs of the application. The flexible shield layers 20 serve to successively impact or shock any hypervelocity particles that collide with the flexible multi-shock shield 10. The concept of using a multi-shock shield to impart multiple impacts or shocks to a hypervelocity particle has been described in commonly assigned U.S. Pat. No. 5,067,388, which is incorporated herein by reference in its entirety. Accordingly, this multi-shock shield concept will not be described in detail here except to say the multiple shocks have the effect of fragmenting and/or vaporizing the hypervelocity particles.

In some embodiments, the flexible shield layers 20 may include sheets of a flexible ceramic material, for example, such as Nextel™ fabric or materials having similar properties and characteristics. The Nextel™ fabric is capable of shocking the hypervelocity particles to break them into smaller pieces and vaporize some of the pieces. Other suitable types of high-strength materials such as Kevlar™, Spectra™, or materials that are yet to be fully developed such as a fullerene coated fabric may also be used for the flexible shield layers 20.

Adjacent ones of the flexible shield layers 20 may be spaced apart and supported by a compressible or resilient support layer 22. The resilient support layer 22, by virtue of its resiliency, allows the flexible multi-shock shield 10 to be folded, compressed, bent, squeezed, rolled, or otherwise reduced in size and/or volume to thereby facilitate easy storage and transport. In some embodiments, where the resilient support layer 22 is made of a ceramic foam such as a Nextel™ foam, the resilient support layer 22 may also be capable of further shocking the hypervelocity particles to thereby help fragment or vaporize the hypervelocity particles as it passes through each resilient support layer 22.

Generally, the thickness h of the resilient support layer 22 may be sufficient to provide adequate spacing between adjacent ones of the flexible shield layers 20. In particular, the thickness h may be a value such that the debris cloud or plume of molten liquid and/or vapor resulting from a hypervelocity particle penetrating one of the flexible shield layers 20 does not puncture the next adjacent flexible shield layer 20 prior to the arrival of the shield layer fragments and debris resulting from the immediately preceding impact, as noted in the above U.S. Pat. No. 5,0670,388. Ideally, the thickness h may be derived so as to provide the lightest weight possible while still meeting the above requirement. In practice, however, other considerations may affect the thickness h of the resilient support layer 22 such as mechanical constraints on the geometry of the shield and launch weight requirements.

In the preferred embodiments, the resilient support layer 22 may be made of a lightweight and compressible material, for example, such as an open cell foam. The open cell foam may be a type of material that is qualified for on-orbit or space applications such as a flexible solomide foam, polymide foam, or a flexible polyurethane foam. A ceramic foam such as Nextel™ foam may also be used for the resilient support layer 22 to provide additional shocking of the hypervelocity particles, as mentioned above.

In other embodiments, the resilient support layer 22 may be made of a lightweight and compressible closed-cell foam. The closed-cell foam may be an elastic material such as silicon sponge rubber, flexible PVC, or polyethylene such as Volara™. Where a closed-cell foam is used, the individual cells may contain a predetermined low-pressure gas (e.g., a fraction of one Atmosphere) such that the cells may occupy a reduced volume under normal pressure, but may expand up to a predetermined maximum volume when exposed to a low pressure or vacuum environment. The membrane of the closed-cell foam may be made of a sufficiently strong material to support the change in pressure without breaking. In alternative embodiments, a closed-cell foam made of a substantially non-elastic material such as a metallic (e.g., aluminum) foam may be used, although the flexibility of the resilient layer 22 may then be somewhat reduced. The individual cells of such a foam then need be only partially filled under normal pressure such that they take up only a fraction of their full volume.

In some embodiments, the resilient support layer 22 and the flexible shield layers 20 may be enclosed or contained in a protective cover 24. The protective cover 24 may serve a variety of purposes as needed including thermal protection of the structure being protected, and facilitating manual handling of the flexible multi-shock shield 10 during storage, transport, and deployment thereof. In particular, the protective cover 24 may have an absorptivity $\alpha$ to emissivity $\epsilon$ ratio selected to provide the desired thermal insulation of the structure being shielded to protect the structure from the extreme temperatures of a space or extraterrestrial environment. The protective cover 24 may also have a sufficiently small porosity and/or arial density in order to insulate crew members and other personnel from emissions by the flexible multi-shock shield 10 that potentially may be irritating to the skin and eyes.

In some embodiments, the protective cover 24 may be made of a high-strength material, for example, such as Betacloth™ or a Teflon™ and fiberglass material that is resistant to abrasions and minor nicks and cuts that can occur during manufacturing and/or storage, transport, and deployment of the flexible multi-shock shield 10. Other suitable types of materials that can be used may include, for example, an aluminized Mylar™ material.

Figure 3:
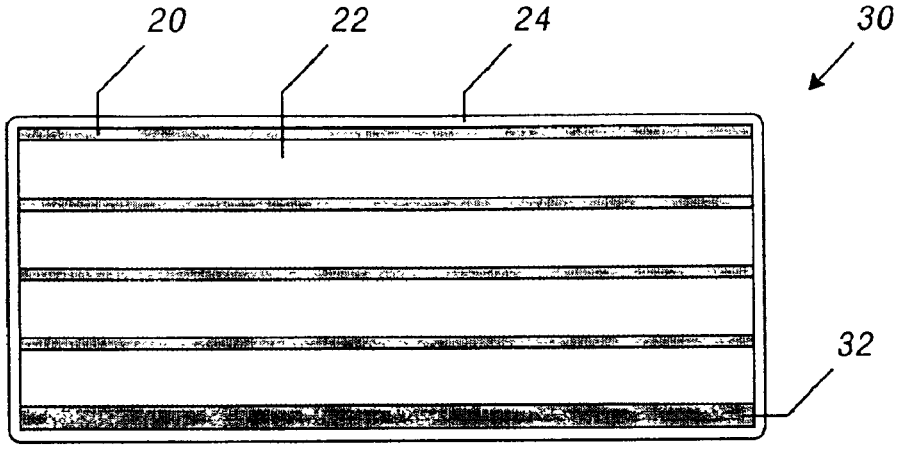
FIG. 3 illustrates a cross-sectional view of another flexible multi-shock shield according to some embodiments of the invention.

FIG. 3 illustrates a close-up cross-sectional view of a flexible multi-shock shield 30 according to still other embodiments of the present invention. As can be seen, except for the addition of a back wall 32, the embodiments of the flexible multi-shock shield 30 shown in FIG. 3 are otherwise similar to the embodiments of the flexible multi-shock shield 10 shown in FIGS. 1 and 2. Such a back wall 32 may serve as the last layer of protection in the flexible multi-shock shield 30 before contact with the surface of the structure to be protected. In embodiments where the protective cover 24 is employed, the back wall 32 may be encapsulated within the protective cover 24; however, where no protective cover 24 is employed, the back wall 32 may be the layer closest to, or touching, the surface of the structure to be protected depending on the design requirements of the particular application. For example, in the habitable modules of a space station, the back wall 32 may be the aluminum pressure shell surrounding the modules.

In some embodiments, the back wall 32 may be made of the same or different material as the flexible shield layers 20 and may have the same or a different thickness. Where the back wall 32 is encapsulated in the protective cover 24, suitable back wall materials may include Nextel™, Kevlar™, or Spectra™ fabric, or other flexible high-strength fabric mentioned herein.

Figure 4:
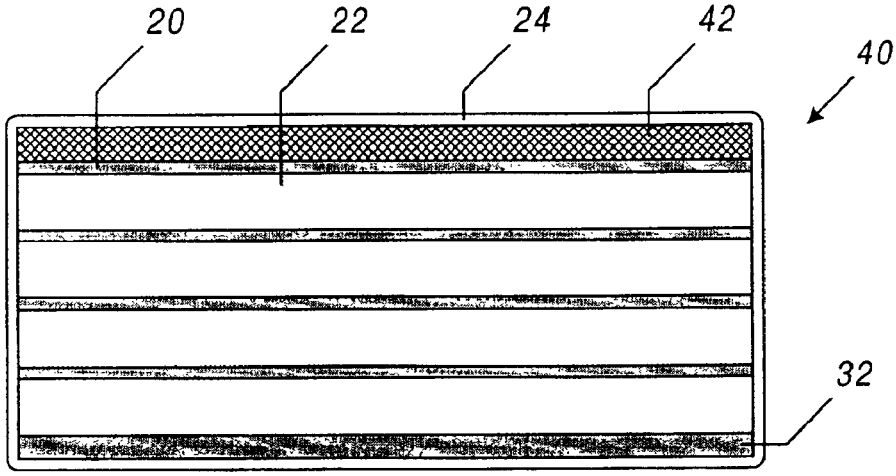
FIG. 4 illustrates a cross-sectional view of still another flexible multi-shock shield according to some embodiments of the invention.

In some embodiments, an optional layer of insulation may be provided as additional thermal insulation within the flexible multi-shock shield, as shown in FIG. 4. The flexible multi-shock shield 40 in FIG. 4, except for the addition of one or more insulation layers 42, may be essentially the same as the flexible multi-shock shield 30 in FIG. 3. In some embodiments, the insulation layer 42 may be positioned adjacent the outermost one of the flexible shield layers 20. Where the protective cover 24 is employed, the insulation layer 42 may be positioned between the outermost one of the flexible shield layers 20 and the protective cover 24. Alternatively, the insulation layer 42 may be disposed external to the protective cover 24 via VELCRO™ hook and loop material fasteners, adhesives, snaps, stitched threads and the like. Suitable materials for the one or more insulation layers 42 may include, for example, a multi-layer insulation (MLI) commonly used for on-orbit thermal protection.

Figure 5:
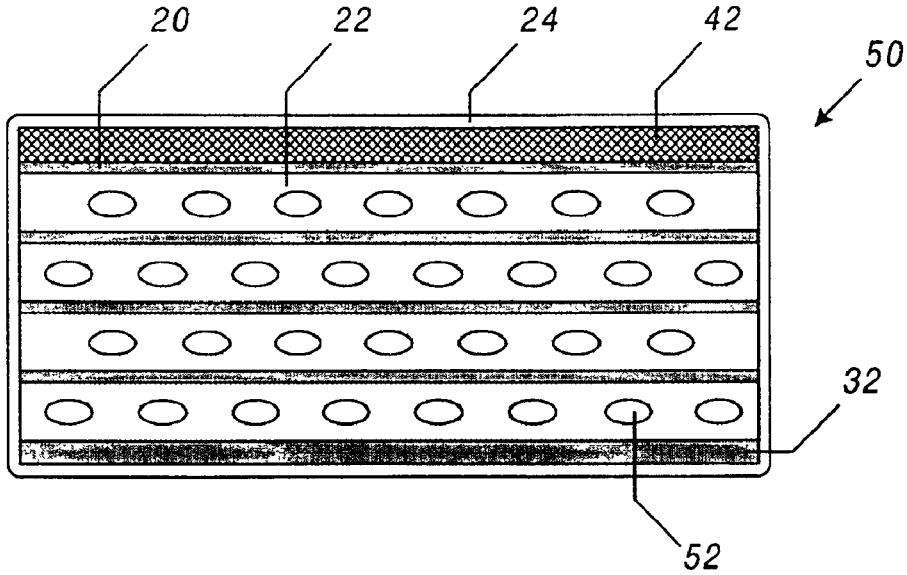
FIG. 5 illustrates a cross-sectional view of yet another flexible multi-shock shield according to some embodiments of the invention.

FIG. 5 illustrates a flexible multi-shock shield 50 according to still other embodiments of the invention. In these embodiments, one or more portions may be cut out of or otherwise removed from one or more resilient support layers as needed without substantially affecting the shape or effectiveness of the shield. The portions may be removed in a manner such that a series of discrete holes may be formed in the resilient support layers 22, or a network of laterally and/or longitudinally extending tunnels 52 may be formed in the resilient support layer 22, or a combination of both. Such an arrangement may be useful where the weight, size and/or volume of the flexible multi-shock shield 50 needs to be reduced in order to facilitate storage, transport, and deployment of the shield.

Figure 6:
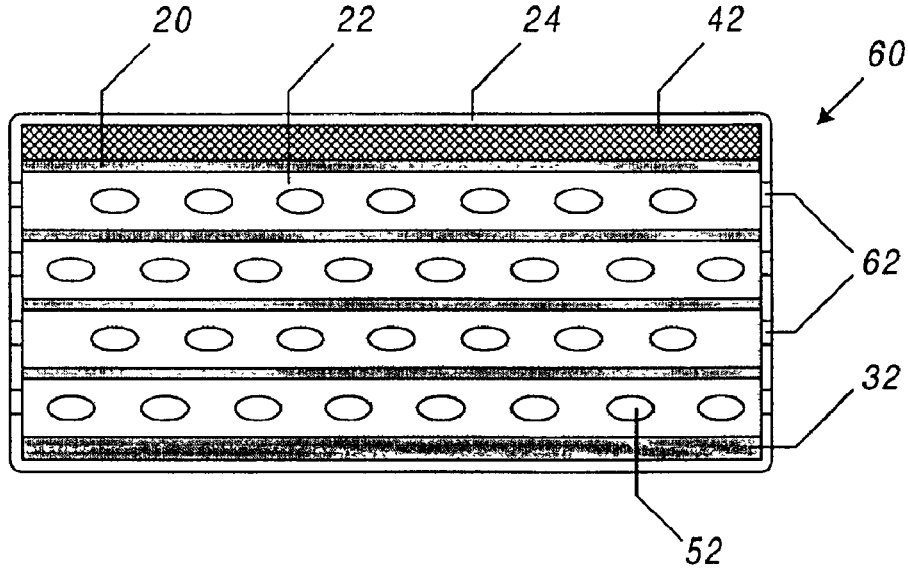
FIG. 6 illustrates a cross-sectional view of yet another flexible multi-shock shield according to some embodiments of the invention.

FIG. 6 illustrates a flexible multi-shock shield 60 according to most embodiments of the invention in which a protective cover 24 is employed. In these embodiments, holes, slits, or perforations 62 may be formed around the periphery of the protective cover 24 on opposing sides of the flexible shield 60 in order to facilitate venting of gas particles that may be generated during a hypervelocity particle collision with the flexible multi-shock shield 10. Additional holes, slits, or perforations 62 may also be formed as needed on the back and/or front faces of the protective cover 24 where the flexible multi-shock shield extends beyond the surface of the structure being protected. The holes, slits, or perforations 62, in conjunction with the tunnels 52 described above, allow the flexible multi-shock shield 10 to vent or release any pressure therein that may have been built up, while substantially containing any solid or liquid debris that may have been produced by the impact of the hypervelocity particle.

Figure 7:
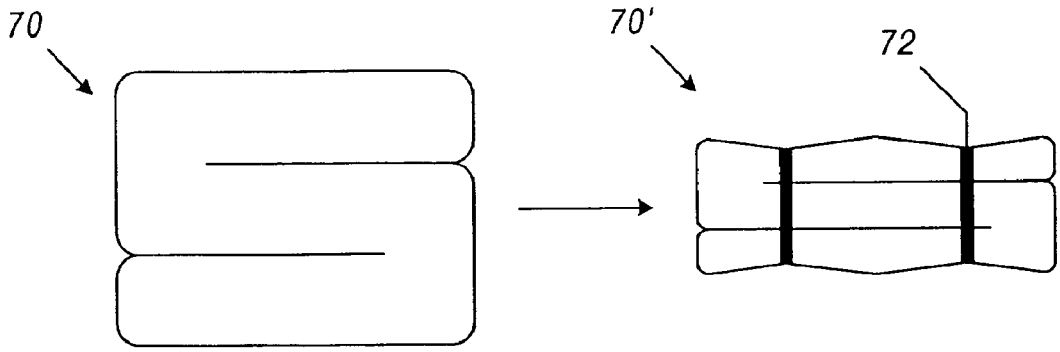
FIG. 7 illustrates a method of compressing and storing a flexible multi-shock shield according to one embodiment of the invention.

FIG. 7 illustrates an exemplary method of reducing or compressing the size and/or volume the flexible multi-shock shield 70 according to some embodiments of invention in order to facilitate storage and transport thereof. In general, the flexible multi-shock shield 70 may be folded, rolled, bent, compressed, squeezed, or otherwise reduced in size and volume, as indicated generally by reference numeral 70', by virtue of the flexibility of the flexible shield layers 20 and the resiliency of the support layers 22. In the exemplary embodiment of FIG. 7, the flexible multi-shock shield 70 may be folded into an S-shaped configuration, compressed into a smaller volume, and then held in the compressed state 70' via one or more straps or bindings 72 tied around the shield. Such an arrangement allows the flexible multi-shock shield 70 to be conveniently and easily stored for transport. The flexible multi-shock shield 70 may thereafter be restored to its full volume and shape simply by releasing the straps or bindings 72.

In some embodiments, the flexible multi-shock shield 70 may be maintained in a compressed state 70' until it is ready to be deployed. For example, it may be more convenient to manipulate the flexible multi-shock shield 70 while in a reduced or compressed state 70' until it is properly positioned in the desired location for deployment. The flexible multi-shock shield 70 may then be expanded to its full volume and shape for mounting and securing on the surface of the structure to be protected.

Figure 8:
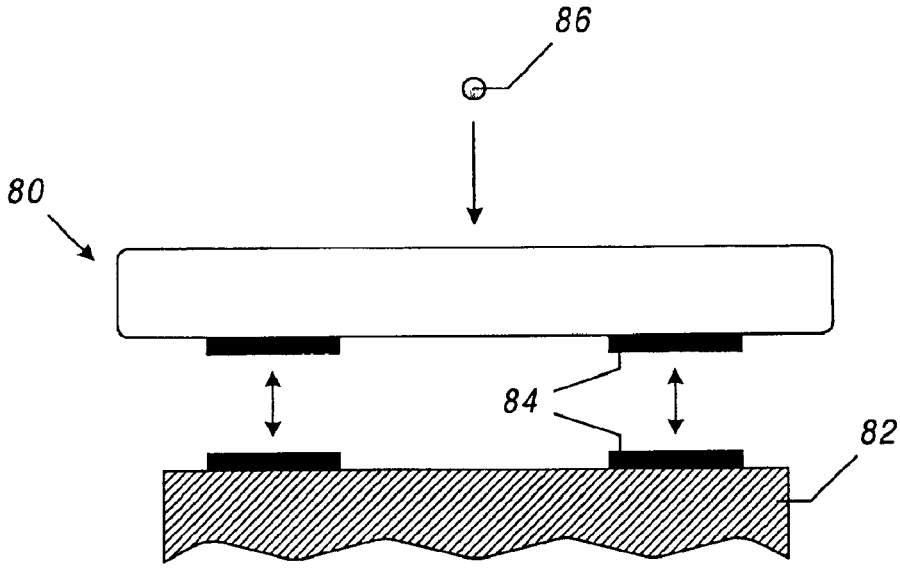
FIG. 8 illustrates a method of deploying a flexible multi-shock shield according to one embodiment of the invention.

FIG. 8 illustrates an exemplary method of deploying a flexible multi-shock shield 80 according to some embodiments of the invention. The flexible multi-shock shield 80 may be releasably secured to the surface of the structure 82 to be protected by one or more fasteners 84. Where a protective cover is used, the fasteners 84 may be attached to the protective cover; otherwise, the fasteners 84 may be attached directly to one of the flexible shield layers or the back wall of the flexible multi-shock shield 80. Such fasteners 84 may include, but are not limited to, VELCRO™ hook and loop material, straps, snaps, ties, hooks, and the like.

In some embodiments, the flexible multi-shock shield 80 is mounted and secured to the surface of the structure to be protected while in a reduced or compressed state, then deployed by cutting or removing the bindings to allow the shield to expand to its original shape and volume. In other embodiments, the flexible multi-shock shield 80 may be fully expanded to its initial shape and volume prior to mounting, and secured thereafter to the surface of the structure 82 to be protected. Maneuvering and positioning of the flexible multi-shock shield 80 may be accomplished manually by the appropriate EVA personnel, or remotely by a remote manipulation system (not expressly shown). When the flexible multi-shock shield 80 is no longer needed, it may be removed from the structure 82 by releasing or otherwise undoing the fasteners 84. The flexible multi-shock shield 80 may thereafter be compressed or otherwise reduced in volume and stored until the next usage.

In designing the flexible multi-shock shield, the specific design parameters may be derived based on the equations below. The equations assume the flexible multi-shock shield has flexible bumpers or shield layers made of Nextel™ fabric that are supported by an open-cell foam and encapsulated in a Betacloth™ cover. One or more insulation layers may also be provided for increased thermal protection of the shield.

Referring still to FIG. 8, for an aluminum hypervelocity projectile 86 having a normal velocity component $V_n$ greater than 6.4 km/s, the areal density $m_b$ of the flexible shield layers may be given by Equation (1):

$$m_b=0.185d\rho_p \tag{1}$$

where $\rho_p$ is the density (g/cm$^3$) of the hypervelocity projectile, and d is the diameter (cm) of the projectile. Should a back wall be employed in the flexible multi-shock shield, the areal density $m_w$ of a back wall that is made of a high-strength material (e.g., Kevlar™ or Spectra™) may be given by Equation (2):

$$m_w=29MV_n/S^2 \tag{2}$$

where M is the projectile mass (g), $V_n$ is the normal component of the projectile velocity (km/s), and S is the overall thickness (cm) of the flexible multi-shock shield from the outermost shield layer to the back wall.

The ballistic limit, that is, the limit beyond which the flexible multi-shock shield may fail, can be expressed in terms of the critical diameter $d_c$ of the hypervelocity projectile. For a high velocity projectile where the velocity V of the projectile is greater than or equal to $6.4/(\cos\theta)^{0.25}$ km/s, the critical diameter $d_c$ of the projectile may be expressed by Equation (3) where θ is the impact angle measured from the surface normal:

$$d_c=0.41m_w^{1/3}\cdot S^{2/3}\cdot\rho_p^{-1/3}\cdot V^{-1/3}(\cos\theta)^{-1/3} \tag{3}$$

For an intermediate velocity projectile where the velocity V of the projectile is less than $6.4/(\cos\theta)^{0.25}$ km/s, but greater than $2.4/(\cos\theta)^{0.5}$ km/s, the critical diameter $d_c$ of the projectile may be expressed by Equation (4):

$$d_c=0.221m_w^{1/3}\cdot S^{2/3}\cdot\rho_p^{-1/3}\cdot(\cos\theta)^{-0.25}\cdot[(V-2.4/(\cos\theta)^{0.5})/(6.4/(\cos\theta)^{0.25}-2.4/(\cos\theta)^{0.5})]+1.506\rho_p^{-1/2}\cdot(0.5m_w+0.37\,m_b)\cdot(\cos\theta)^{-1}\cdot[(6.4/(\cos\theta)^{0.25}-V)/(6.4/(\cos\theta)^{0.25}-2.4/(\cos\theta)^{0.5})] \tag{4}$$

For a low velocity projectile where the velocity V of the projectile is less than $2.4/(\cos\theta)^{0.5}$ km/s, the critical diameter $d_c$ of the projectile may be expressed by Equation (5):

$$d_c=2.7\,V^{-2/3}(\cos\theta)^{-1/3}\rho_p^{-1/2}[0.5m_w+0.37m_{b1}] \tag{5}$$

Figure 9:
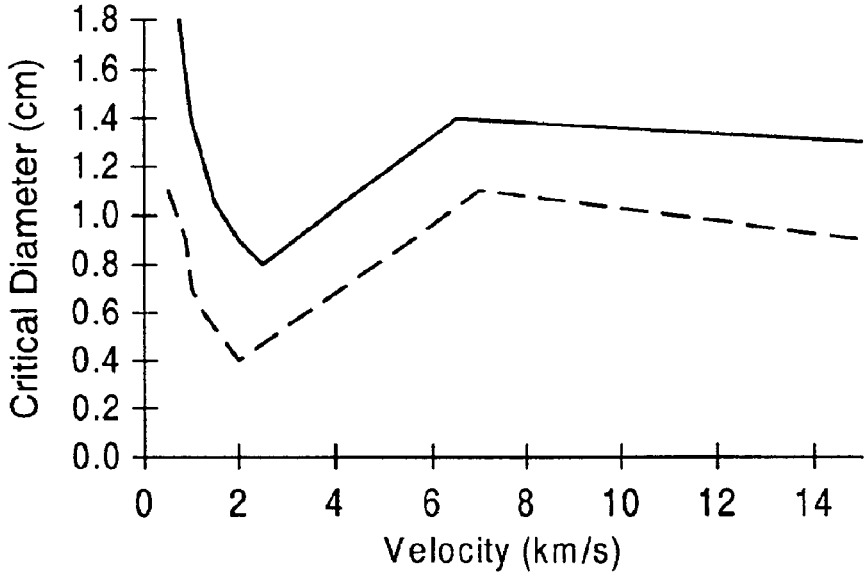
FIG. 9 illustrates a graph comparing the ballistic limits of the flexible multi-shock shield according to some embodiments of the invention against a prior art shield.

FIG. 9 is a chart comparing the ballistic limit of an exemplary flexible multi-shock shield against that of a prior art dual bumper, or Whipple, shield. In the chart of FIG. 9, the vertical axis represents the critical diameter (cm) of the projectile and the horizontal axis represents the velocity (km/s) of the projectile. The solid line represents the ballistic limit of the flexible multi-shock shield, above which shield failure is likely to result. As can be seen, the ballistic limit of the flexible multi-shock shield is substantially higher than that of the so-called Whipple shield, which is represented by the broken line.

As demonstrated above, embodiments of the invention provide a versatile, lightweight and flexible multi-shock shield that is capable of defending against hypervelocity particles. Advantages of the flexible multi-shock shield include being easily and conveniently stored, transported, and deployed. Furthermore, the flexible multi-shock shield may be scaled and fitted for any number of sizes, shapes and/or configurations to suit a particular shielding application. For example, in addition to the pad or mattress configuration described above, one or more of the flexible multi-shock shields may be configured as a space station habitation module, a garage for space vehicles, a container for on-orbit scientific experiments, a hatch cover, a window cover, satellite shielding, and the like. In some embodiments, the flexible multi-shock shield may also be used to augment existing protection systems. Additionally, the flexible multi-shock shield may be adapted to any number of ground based applications such as portable shelters for use by forest fire fighters. Such shelters may be made of a flame retardant material such as Nextel™ fabric and may be air dropped to the fire fighters as needed, then inflated to deploy. The flexible multi-shock shield may also be used as military tank armor to protect against shaped-charges and other hypervelocity projectiles designed to pierce conventional armor. Where needed, the flexible multi-shock shield may be provided with an appropriate coating such as an optically reflective or absorptive coating. Other advantages provided by the embodiments of the invention are apparent to those skilled in the art and will not be described here.

While a limited number of embodiments of the invention have been described, these embodiments are not intended to limit the scope of the invention as otherwise described and claimed herein. Variations and modifications from the described embodiments exist, and those of ordinary skill in the art will recognize that numerous configurations, both planar and non-planar, for on-orbit and on the ground applications, may be derived without departing from the scope of the invention. All numerical values disclosed herein are approximate values only regardless of whether that term was used in describing the values. Moreover, unless otherwise specified, the steps of any methods described herein may be practiced in any order or sequence, and some steps may be omitted, combined into a single step, or divided into several sub-steps. Accordingly, the appended claims are intended to cover all such variations and modifications as falling within the scope of the invention.

What is claimed is:

1. A hypervelocity particle shield for protection against at least one hypervelocity particle having a normal velocity component greater than 6.4 km/s, comprising:

a plurality of spaced apart flexible shield layers, at least one of which is made of a flexible ceramic fabric;

a resilient support layer between adjacent ones of the flexible shield layers, the resilient support layer including at least one space qualified foam layer, wherein the at least one flexible shield layer has an areal density ($m_b$) that is substantially equal to $m_b$=0.185·d·$\rho_p$, wherein d equals the diameter of the hypervelocity particle, and $\rho_p$ equals the density of the hypervelocity particle;

at least one thermal insulation layer disposed on the plurality of flexible shield layers;

a vented, abrasion resistant protective cover configured to enclose the flexible shield layers and having an absorptivity to emissivity ratio selected to provide a predetermined level of thermal protection; and fasteners attached to the protective cover and capable of releasably securing the flexible shield layers to a structure to be protected.

2. The hypervelocity particle shield of claim 1, wherein the space qualified foam layer includes an open-cell foam layer.

3. The hypervelocity particle shield of claim 1, wherein the space qualified foam layer includes a closed-cell foam layer, each cell therein containing a predetermined low-pressure gas.

4. The hypervelocity particle shield of claim 1, wherein the support layer further includes a ceramic foam layer.

5. The hypervelocity particle shield of claim 1, wherein the support layer has one or more portions removed therefrom.

6. The hypervelocity particle shield of claim 1, wherein the fasteners include one or more snap fasteners.

7. The hypervelocity particle shield of claim 1, wherein the fasteners include one or more straps.

8. The hypervelocity particle shield of claim 1, wherein the fasteners include at least one VELCRO™ hook and loop material fastener.

9. A particle shield designed to provide reliable protection against at least one hypervelocity particles having a normal velocity component greater than 6.4 km/sec, comprising:

a plurality of flexible shield layers wherein at least one flexible shield layer has an areal density ($m_b$) that is substantially equal to $m_b$0.185·d·$\rho_p$, wherein d equals the diameter of the hypervelocity particle, and $\rho_p$ equals the density of the hypervelocity particle;

a resilient support layer between adjacent ones of the flexible shield layers;

a protective cover configured to enclose the flexible shield layers; and fasteners associated with the protective cover and capable of releasably securing the flexible shield layers to a structure to be protected.

10. A particle shield designed to provide reliable protection against an impact of at least one hypervelocity particle, comprising:

a plurality of flexible shield layers comprising at least one back wall layer;

a resilient support layer between adjacent ones of the flexible shield layers;

a protective cover configured to enclose the flexible shield layers; and fasteners associated with the protective cover and capable of releasably securing the flexible shield layers to a structure to be protected, wherein the particle shield has an overall thickness (S) that is based on a critical diameter ($d_c$) of the hypervelocity particle to be shocked, wherein $$d_c=0.41m_w^{1/3}\cdot S^{2/3-}\cdot\rho_p^{-1/3}\cdot V^{-1/3}(\cos\theta)^{31\ 1/3}$$

for V greater than or equal to 6.4/(cos θ)$^{0.25}$ km/s, $$d_c 0.221m_w^{1/3}\cdot S^{2/3}\cdot\rho_p^{-1/3}\cdot(\cos\theta)^{-0.25}\cdot[(V-2.4/\cos\theta)^{0.5})/(6.4/(\cos\theta)^{0.25}-2.4/(\cos\theta)^{0.5})]+1.506\rho_p^{-1/2}\cdot(0.5m_w+0.37m_b)\cdot(\cos\theta)^{-1}\cdot[(6.4/(\cos\theta)^{0.25}-V)/(6.4/(\cos\theta)^{0.25}-2.4/(\cos\theta)^{0.5})]$$

for V less than 6.4/(cos θ)$^{0.25}$ km/s, but greater than 2.4/(cos θ)$^{0.5}$ km/s, or $$d_c=2.7\ V^{-2/3}(\cos\theta)^{-1/3}\rho_p^{-1/2}[0.5m_w+0.37m_b]$$

for V less than 2.4/(cos θ)$^{0.5}$ km/s, and wherein $m_w$ is the areal density of the back wall layer, $m_b$ is the areal density of the flexible shield layer that is not a back wall layer, V is the velocity of the hypervelocity particle, $\rho_p$ is the density of the hypervelocity particle, and θ is the impact angle measured from a vector normal to the impact surface.

* * * * *